US010174480B2

(12) United States Patent
Tanaka et al.

(10) Patent No.: US 10,174,480 B2
(45) Date of Patent: Jan. 8, 2019

(54) WORK MACHINE

(71) Applicant: SUMITOMO (S.H.I.) CONSTRUCTION MACHINERY CO., LTD., Tokyo (JP)

(72) Inventors: Yousuke Tanaka, Chiba (JP); Kenichi Sasaki, Chiba (JP)

(73) Assignee: SUMITOMO (S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 15/596,092

(22) Filed: May 16, 2017

(65) Prior Publication Data

US 2017/0247858 A1 Aug. 31, 2017

Related U.S. Application Data

(63) Continuation of application No. PCT/JP2015/082099, filed on Nov. 16, 2015.

(30) Foreign Application Priority Data

Nov. 19, 2014 (JP) ..... 2014-234877

(51) Int. Cl.
*E02F 9/18* (2006.01)
*E02F 9/08* (2006.01)
(Continued)

(52) U.S. Cl.
CPC ..... *E02F 9/0808* (2013.01); *E02F 3/38* (2013.01); *E02F 9/0866* (2013.01);
(Continued)

(58) Field of Classification Search
CPC ..... E02F 9/08; E02F 9/0866; E02F 9/0883; E02F 9/16; E02F 9/18; E02F 9/2292; E02F 3/38; E02F 3/32; F02M 37/0076
See application file for complete search history.

(56) References Cited

U.S. PATENT DOCUMENTS 7,681,556 B2 3/2010 Hwang
8,459,014 B2 6/2013 Kamiya et al.
(Continued)

FOREIGN PATENT DOCUMENTS

JP 2002-090205 3/2002
JP 2003-268807 9/2003
(Continued)

OTHER PUBLICATIONS

International Search Report for PCT/JP2015/082099 dated Feb. 2, 2016.

*Primary Examiner* — Emma K Frick
*Assistant Examiner* — Brian L Cassidy
(74) *Attorney, Agent, or Firm* — IPUSA, PLLC

(57) ABSTRACT

A work machine includes a lower-part traveling body, an upper-part turning body, an arm, a boom, a cab, an engine, a fuel tank, and a counterweight. The upper-part turning body is turnably disposed on the lower-part traveling body. The boom has a first end connected to the upper-part turning body and a second end connected to the arm. The cab is mounted on a front left of a frame of the upper-part turning body. The engine is disposed behind the cab on the frame. The fuel tank is disposed behind the engine on the frame. The counterweight is disposed behind the fuel tank on the frame. The fuel tank is disposed in a hollow formed in the counterweight.

14 Claims, 6 Drawing Sheets

(51) Int. Cl.

| | |
|---|---|
| ***E02F 3/38*** | (2006.01) |
| ***E02F 9/16*** | (2006.01) |
| ***F02M 37/00*** | (2006.01) |
| *E02F 3/32* | (2006.01) |
| *E02F 9/22* | (2006.01) |

(52) U.S. Cl.
CPC ..... *E02F 9/0883* (2013.01); *E02F 9/16* (2013.01); *E02F 9/18* (2013.01); *F02M 37/0076* (2013.01); *E02F 3/32* (2013.01); *E02F 9/2292* (2013.01)

(56) References Cited

U.S. PATENT DOCUMENTS

| | | | | |
|---|---|---|---|---|
| 2011/0017537 | A1 | 1/2011 | Kndou et al. | |
| 2015/0139768 | A1* | 5/2015 | Egawa | E02F 9/18 414/719 |
| 2016/0138242 | A1* | 5/2016 | Hwang | E02F 3/32 180/69.4 |
| 2017/0247858 | A1* | 8/2017 | Tanaka | E02F 9/0808 |

FOREIGN PATENT DOCUMENTS

| | | |
|---|---|---|
| JP | 2004-204651 | 7/2004 |
| JP | 2006-057291 | 3/2006 |
| JP | 2006-169853 | 6/2006 |
| JP | 2008-007099 | 1/2008 |
| JP | 2009-001088 | 1/2009 |
| JP | 2009-144511 | 7/2009 |
| JP | 2009-162137 | 7/2009 |
| JP | 2009-179960 | 8/2009 |
| WO | 2006/080495 | 8/2006 |

* cited by examiner

WORK MACHINE

CROSS-REFERENCE TO RELATED APPLICATIONS

The present application is a continuation application filed under 35 U.S.C. 111(a) claiming benefit under 35 U.S.C. 120 and 365(c) of PCT International Application No. PCT/JP2015/082099, filed on Nov. 16, 2015 and designating the U.S., which claims priority to Japanese Patent Application No. 2014-234877, filed on Nov. 19, 2014. The entire contents of the foregoing applications are incorporated herein by reference.

BACKGROUND

Technical Field

The present invention generally relates to work machines provided with a counterweight and a fuel tank.

Description of Related Art

Work machines include an upper-part turning body that includes a cab in which an operator sits, a fuel tank to store fuel, and a counterweight that counterbalances a boom, an arm, etc. The fuel tank is disposed on one side of the upper-part turning body, and the counterweight is disposed in the rear of the upper-part turning body.

SUMMARY

According to an aspect of the present invention, a work machine includes a lower-part traveling body, an upper-part turning body, an arm, a boom, a cab, an engine, a fuel tank, and a counterweight. The upper-part turning body is turnably disposed on the lower-part traveling body. The boom has a first end connected to the upper-part turning body and a second end connected to the arm. The cab is mounted on a front left of a frame of the upper-part turning body. The engine is disposed behind the cab on the frame. The fuel tank is disposed behind the engine on the frame. The counterweight is disposed behind the fuel tank on the frame. The fuel tank is disposed in a hollow formed in the counterweight.

It is to be understood that both the foregoing general description and the following detailed description are exemplary and explanatory and not restrictive of the invention.

DETAILED DESCRIPTION

Work machines may be operated at work sites remote from refueling facilities. In such a case, it is possible to increase the size of a fuel tank to reduce the number of times a work machine travels to refueling facilities.

In the case of increasing the size of a fuel tank on one side of the upper-part turning body where the fuel tank is conventionally disposed, the fuel tank can only be enlarged upward or toward the front. The cab, however, is disposed on the opposite side of the upper-part turning body from the fuel tank. Accordingly, there is a problem in that enlarging the fuel tank upward or toward the front impairs operator visibility to reduce work efficiency.

According to an aspect of the present invention, a work machine that achieves an increase in the size of a fuel tank while keeping good operator visibility is provided.

A non-limiting embodiment of the present invention is described below with reference to the accompanying drawings.

Figure 1:
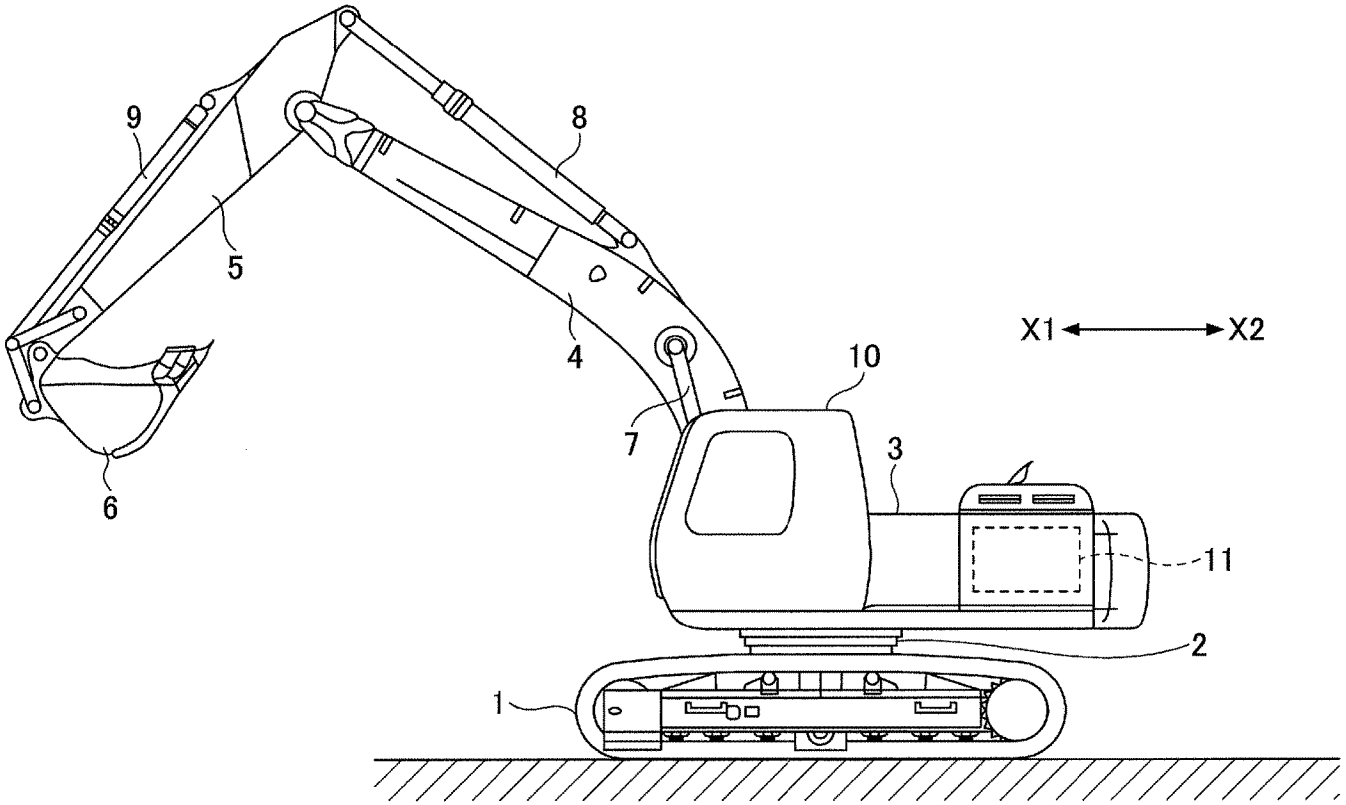
FIG. 1 is a side view of a shovel according to an embodiment of the present invention.

FIG. 1 is a side view of a shovel (excavator), which is an example of construction machines, which are examples of work machines according to this embodiment. The shovel includes a lower-part traveling body 1, a turning mechanism 2, and an upper-part turning body 3. The upper-part turning body 3 is turnably mounted on the lower-part traveling body 1 via the turning mechanism 2. A boom 4 is attached to the upper-part turning body 3. An arm 5 is attached to the end of the boom 4. A bucket 6 serving as an end attachment is attached to the end of the arm 5. The end attachment is not limited to the bucket 6. For example, a grapple or a harvester may be attached as an end attachment.

The boom 4, the arm 5, and the bucket 6 form an excavation attachment, which is an example of attachments, and are hydraulically driven by a boom cylinder 7, an arm cylinder 8, and a bucket cylinder 9, respectively. Furthermore, the upper-part turning body 3 includes a cab 10 and power sources such as an engine 11.

Figure 2:
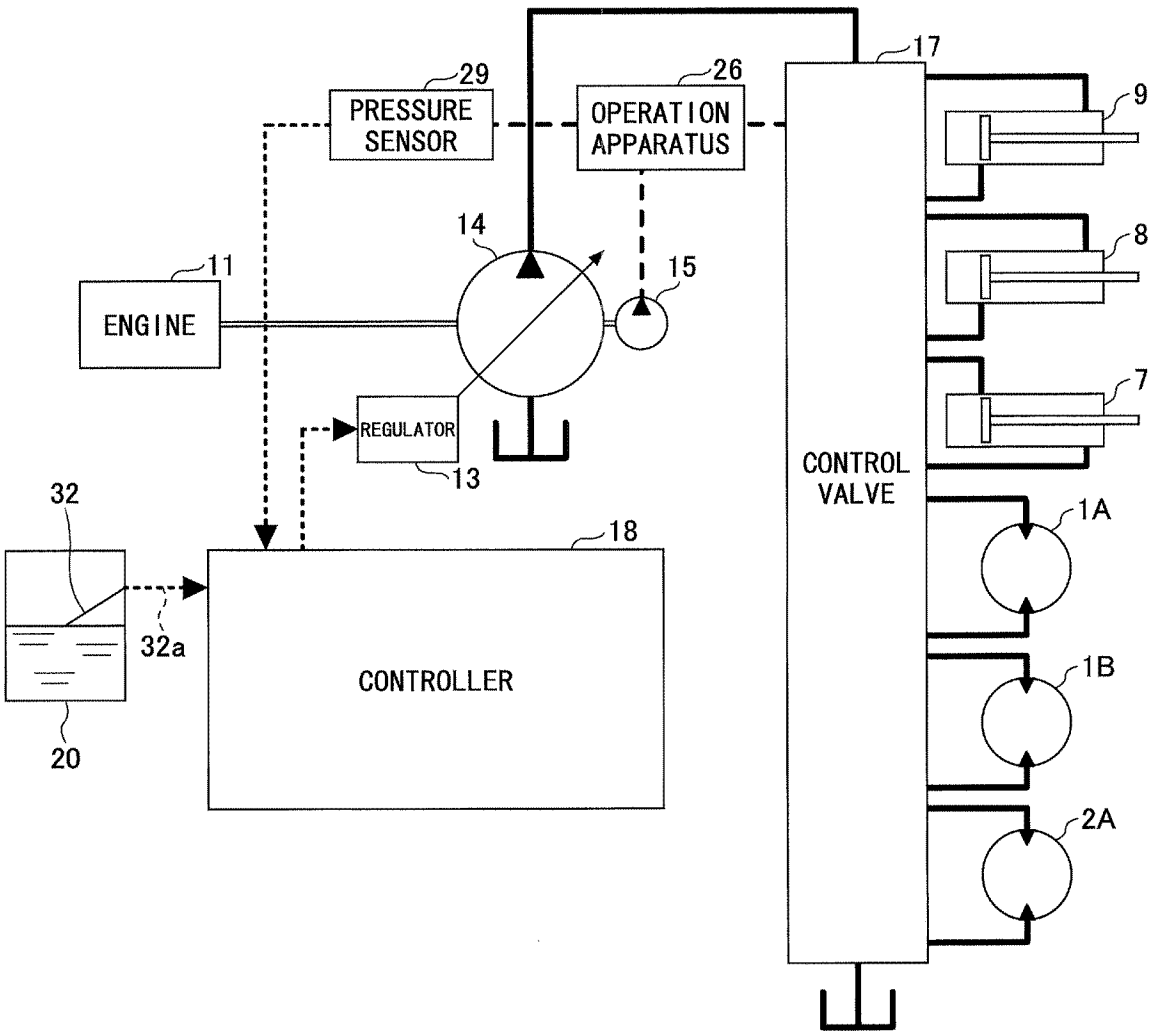
FIG. 2 is a diagram depicting an arrangement of the drive system of the shovel according to the embodiment.

FIG. 2 is a block diagram depicting an arrangement of the drive system of the shovel of FIG. 1. In FIG. 2, a mechanical power system, a high-pressure hydraulic line, a pilot line, and an electrical drive and control system are indicated by a double line, a thick solid line, a thick dashed line, and a thin dashed line, respectively.

The drive system of the shovel includes the engine 11, a regulator 13, a main pump 14, a pilot pump 15, a control valve 17, an operation apparatus 26, a pressure sensor 29, a controller 18, and a remaining amount sensor 32.

The engine 11 is the drive source of the shovel. The engine 11 is supplied with fuel from a fuel tank 20. According to this embodiment, for the engine 11, a diesel engine is used as an internal combustion engine that operates to maintain a predetermined rotation speed. The output shaft of the engine 11 is coupled to the input shafts of the main pump 14 and the pilot pump 15.

The main pump 14 supplies hydraulic oil to the control valve 17 through a high-pressure hydraulic line. According to this embodiment, the main pump 14 is a swash-plate variable displacement hydraulic pump.

The regulator 13 regulates the discharge quantity of the main pump 14. According to this embodiment, the regulator 13 regulates the discharge quantity of the main pump 14 by controlling the swash plate tilt angle of the main pump 14 in accordance with the discharge pressure of the main pump 14, a control signal from the controller 18, etc.

The pilot pump 15 supplies hydraulic oil to various hydraulic control apparatuses via a pilot line. According to this embodiment, the pilot pump 15 is a fixed displacement hydraulic pump.

The control valve 17 is a hydraulic controller that controls the hydraulic system of the shovel. According to this embodiment, the control valve 17 selectively supplies hydraulic oil discharged by the main pump 14 to one or more of the boom cylinder 7, the arm cylinder 8, the bucket cylinder 9, a left-side traveling hydraulic motor 1A, a right-side traveling hydraulic motor 1B, and a turning hydraulic motor 2A.

In the following, the boom cylinder 7, the arm cylinder 8, the bucket cylinder 9, the left-side traveling hydraulic motor 1A, the right-side traveling hydraulic motor 1B, and the turning hydraulic motor 2A are collectively referred to as "hydraulic actuators."

The operation apparatus 26 is an apparatus that an operator of the shovel uses to operate the hydraulic actuators. According to this embodiment, the operation apparatus 26 supplies hydraulic oil discharged by the pilot pump 15 to the pilot ports of control valves in the control valve 17. Specifically, the operation apparatus 26 supplies hydraulic oil discharged by the pilot pump 15 to the pilot ports of control valves corresponding to the individual hydraulic actuators.

The pressure (pilot pressure) of hydraulic oil supplied to each pilot port is a pressure commensurate with the direction of operation and the amount of operation of a lever or pedal of the operation apparatus 26 corresponding to each hydraulic actuator.

The pressure sensor 29 is an example of a specific operation detecting part configured to detect a specific operation of the operation apparatus 26. According to this embodiment, the pressure sensor 29 detects the direction of operation and the amount of operation of the operation apparatus 26 corresponding to each hydraulic actuator in the form of pressure, and outputs a detected value to the controller 18.

A specific operation of the operation apparatus 26 may be detected using a sensor other than a pressure sensor, such as an inclination sensor configured to detect the inclinations of various operation levers. Specifically, the pressure sensor 29 is attached to the operation apparatus 26 with respect to each of levers such as a left-side traveling lever, a right-side traveling lever, an arm operation lever, a turning operation lever, a boom operation lever, and a bucket operation lever.

Figure 3A:
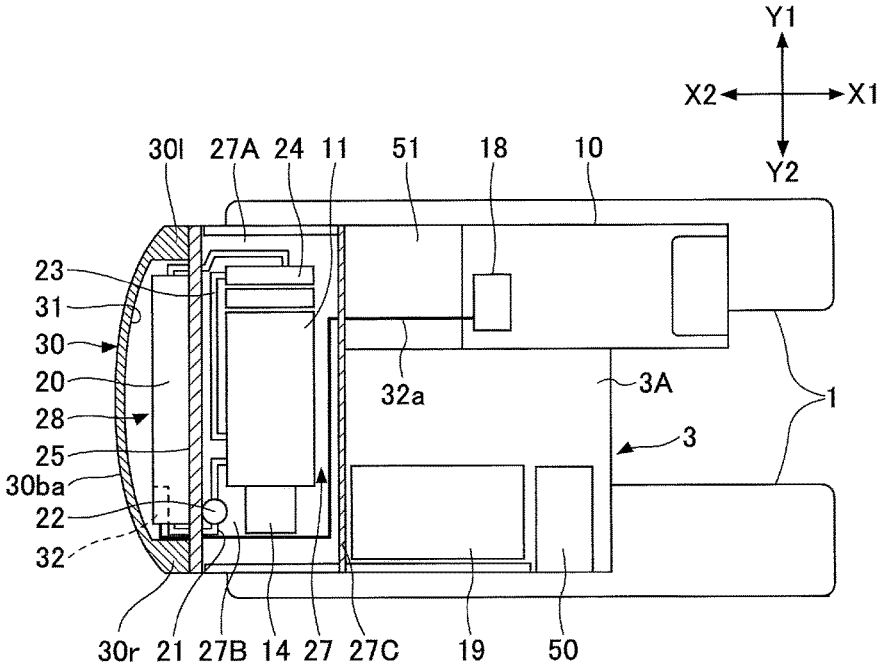
FIGS. 3A and 3B are a plan view and a side view, respectively, of the shovel, depicting an internal arrangement of an upper-part turning body of the shovel, according to the embodiment.

The remaining amount sensor 32 detects the amount of fuel remaining in the fuel tank 20. The remaining amount sensor 32 may be, but is not limited to, for example, a float sensor. Referring to FIG. 3A, a cable 32*a* connected to the remaining amount sensor 32 is inserted through a through hole provided in a partition plate 25 to be led out into a hydraulic pump chamber 27B in an engine chamber 27. The cable 32*a* is further inserted through an insertion hole provided in a shield wall 27C to be led out into an air filter chamber 51 to be connected to the controller 18 disposed in the cab 10.

The controller 18 is a control unit for controlling the shovel. According to this embodiment, the controller 18 is a computer including a central processing unit (CPU), a random access memory (RAM), and a read-only memory (ROM). The controller 18 reads programs corresponding to functional elements from the ROM, loads the read programs into the RAM, and causes the CPU to execute processes corresponding to the functional elements.

Furthermore, the controller 18 electrically detects specific operations of the operation apparatus 26 based on the outputs of the pressure sensor 29. Examples of specific operations include the presence or absence of a lever operation, the direction of a lever operation, and the amount of a lever operation.

FIGS. 3A, 3B, 4, 5 and 6 are diagrams for illustrating an internal arrangement of the upper-part turning body 3. In the following description, with respect to a position in the shovel, the direction indicated by the arrow X1 is a direction toward the front or a forward direction, the direction indicated by the arrow X2 is a direction toward the rear or a rearward direction, the direction indicated by the arrow Y1 is a direction toward the left or a leftward direction, and the direction indicated by the arrow Y2 is a direction toward the right or a rightward direction.

Figure 3B:
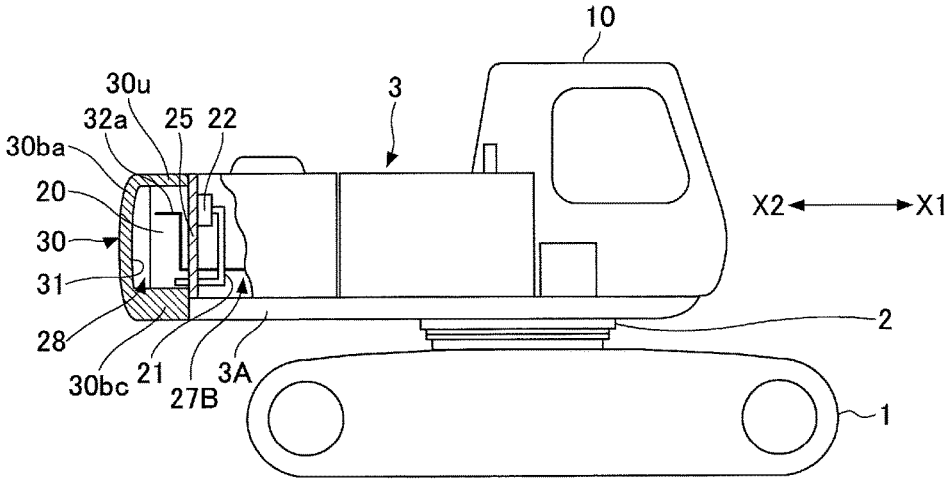
Figure 5:
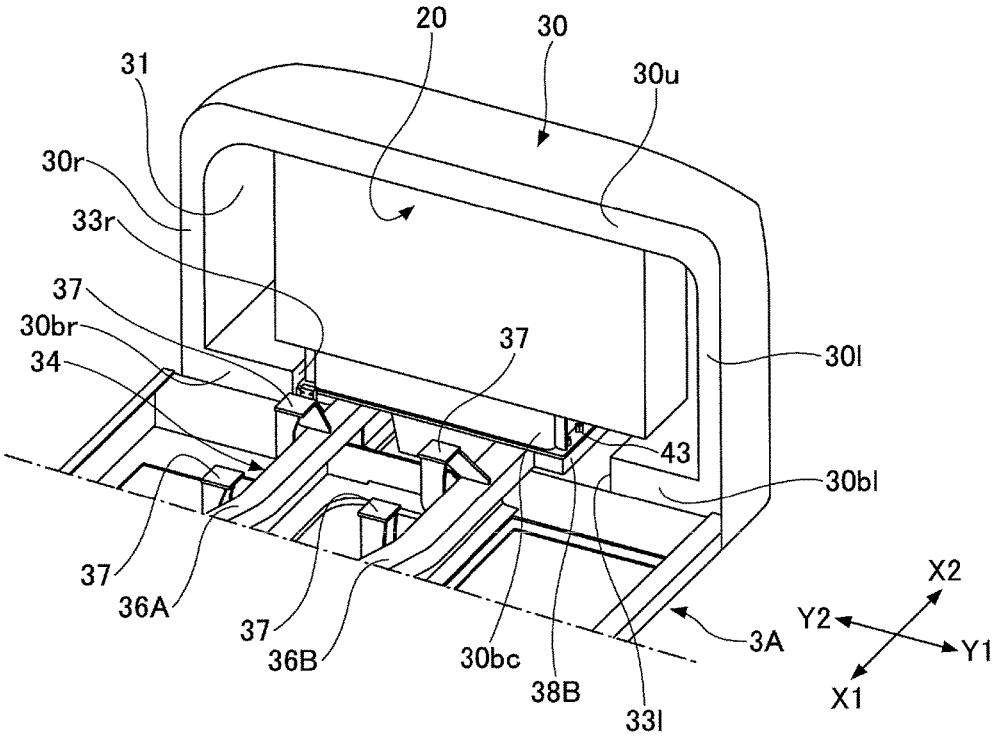
FIG. 5 is a perspective view of a counterweight of the shovel to which a fuel tank is attached according to the embodiment.

Referring to FIGS. 3A, 3B and 5, the upper-part turning body 3 includes a turning frame 3A. The cab 10, the engine 11, a hydraulic oil tank 19, the fuel tank 20, the partition plate 25, the shield wall 27C, a counterweight 30, and a tool box 50 are mounted on the turning frame 3A.

The cab 10 is mounted on the front left of the turning frame 3A. The engine 11 is disposed in the engine chamber 27 behind the cab 10. The main pump 14 is attached inside the hydraulic pump chamber 27B to the right of the engine 11. The main pump 14 is driven by the engine 11 to supply hydraulic oil to the control valve 17 via a high-pressure hydraulic line.

The fuel tank 20 is disposed behind the engine 11. According to this embodiment, the fuel tank 20 is large enough to enable the shovel to operate for a few days without being refueled.

In common work machines, a fuel tank is disposed to the right of a cab. This disposition of the fuel tank requires the fuel tank to be enlarged upward or forward to increase its size, and thus may impair visibility from the cab. By disposing the fuel tank 20 behind the engine 11 as in this embodiment, however, the visibility from the cab 10 is prevented from being impaired by an increase in the size of the fuel tank 20.

The partition plate 25 is disposed between the engine 11 and the fuel tank 20. Furthermore, the partition plate 25 is installed on a frame body fixed to the turning frame 3A. The partition plate 25 separates the engine chamber 27 in which the engine 11 is disposed and a fuel tank chamber 28 in which the fuel tank 20 is disposed. As a result, heat generated from the engine 11, etc., in the engine chamber 27 is blocked by the partition plate 25, and accordingly, is prevented from affecting the fuel tank 20.

A supply conduit 21 serving as a fuel hose for supplying fuel stored in the fuel tank 20 and a return conduit 23 serving as a fuel hose for returning excess fuel in the engine 11 to the fuel tank 20 are provided between the engine 11 and the fuel tank 20. A fuel pump 22 for pumping fuel from the fuel tank 20 to the engine 11 is provided in the supply conduit 21. A radiator 24 provided in a radiator chamber 27A is connected to the return conduit 23 to cool fuel whose temperature has increased in the engine 11 before the fuel is returned to the fuel tank 20.

As described above, the partition plate 25 is provided between the engine 11 and the fuel tank 20. Referring to FIG. 3A, the supply conduit 21 and the return conduit 23 pierce through the partition plate 25. That is, the supply conduit 21 serving as a fuel hose is routed to the hydraulic pump chamber 27B through the partition plate 25 to connect to the fuel pump 22 disposed in the hydraulic pump chamber 27B. The return conduit 23 serving as a fuel hose is routed to the fuel tank chamber 28 through the partition plate 25 to connect to the fuel tank 20 disposed in the fuel tank chamber 28. Accordingly, it is possible to supply and collect fuel between the engine 11 and the fuel tank 20 even with the partition plate 25.

The counterweight 30 is disposed behind the fuel tank 20. According to this embodiment, the counterweight is a cast.

Referring to FIGS. 3A, 3B, 4 and 5, the counterweight 30 includes an upper wall 30*u*, a right-side wall 30*r*, a left-side wall 30*l*, a right bottom wall 30*br*, a center bottom wall 30*bc*, a left bottom wall 30*bl*, and a rear wall 30*ba*.

The upper wall 30*u*, the right-side wall 30*r*, the left-side wall 30*l*, the right bottom wall 30*br*, the center bottom wall 30*bc*, and the left bottom wall 30*bl*form a rectangular frame body, and the rear wall 30*ba* closes one of the openings of the frame body. Accordingly, a hollow or space 31 is formed in the counterweight 30.

The fuel tank 20 is attachable inside the hollow 31. Accordingly, the counterweight 30 is attached to the upper-part turning body 3 to cover the fuel tank 20.

The fuel tank 20 is disposed to have its front face in the same plane as or offset rearward relative to the front end face of the counterweight 30.

The fuel tank 20 is increased in weight because of its increase in size. When filled with fuel, the fuel tank 20 becomes heavier. According to this embodiment, the heavy fuel tank 20 is attached inside the counterweight 30 to be used as part of the counterweight 30. This arrangement makes it possible to prevent the counterweight 30 from projecting rearward and to increase the size of the fuel tank 20 without increasing the swing clearance of the upper-part turning body 3.

Figure 4:
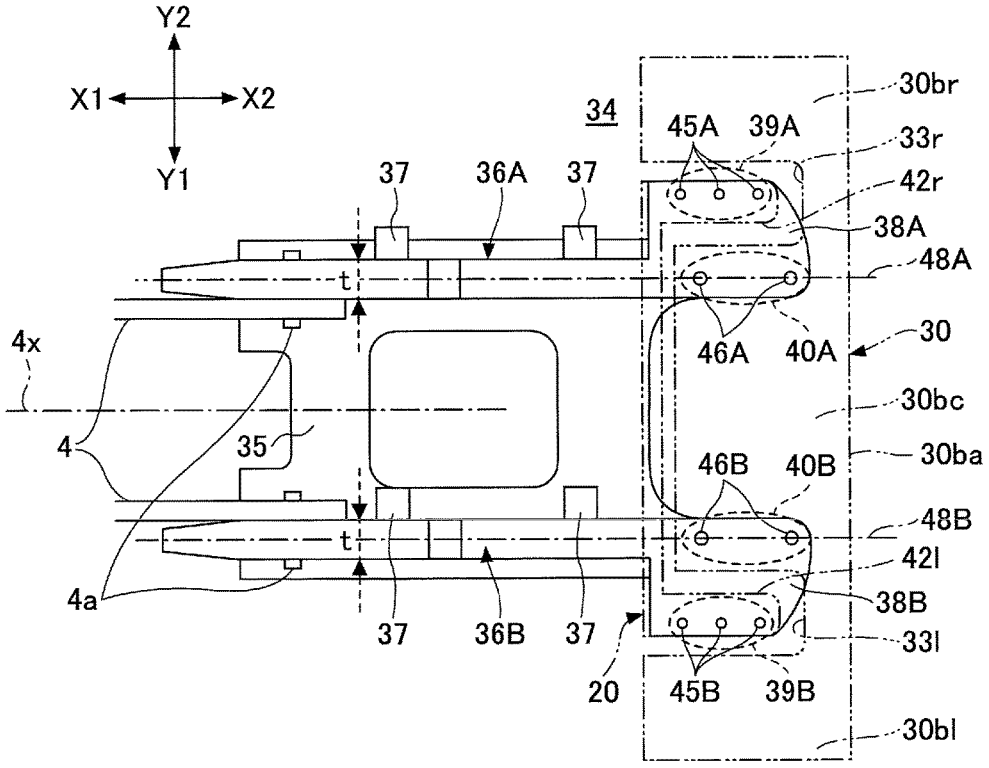
FIG. 4 is a plan view of an engine frame of the shovel according to the embodiment.

The right bottom wall 30*br*, the center bottom wall 30*bc*, and the left bottom wall 30*bl*form the bottom of the counterweight 30. Referring to FIG. 4, a right-side cut 33*r* is formed between the right bottom wall 30*br* and the center bottom wall 30*bc*, and a left-side cut 331 is formed between the left bottom wall 30*bl*and the center bottom wall 30*bc*. The hollow 31 formed inside the counterweight 30 communicates with the outside of the counterweight 30 through the right-side cut 33*r* and the left-side cut 33*l*.

According to this embodiment, the right-side cut 33*r* and the left-side cut 33*l* extend rearward (in the direction of the arrow X2) from the front (inner) end face of the counterweight 30 (facing toward the engine chamber 27) up to in front of the rear wall 30*ba*. Alternatively, the right-side cut 33*r* and the left-side cut 33*l* may be through holes that pierce through the rear wall 30*ba*.

The engine 11, the fuel tank 20, and the counterweight 30 are mounted on an engine frame 34 forming part of the turning frame 3A.

Referring to FIG. 4, the engine frame 34 includes a base 35 and beams 36A and 36B. The beams 36A and 36B are provided on the base 35 to project forward and rearward from the turning frame 3A. The beams 36A and 36B are disposed at a predetermined interval in the right-left direction (the width [transverse] direction of the shovel).

The boom 4 is pivotably attached to the front end of each of the beams 36A and 36B through boom foot pins 4*a*.

Two engine mounts 37 are provided in the middle of each of the beams 36A and 36B. The engine 11 is mounted on the four engine mounts 37.

The beams 36A and 36B include widened rear ends 38A and 38B, respectively. The rear ends 38A and 38B include respective fuel tank mounts 39A and 39B on which the fuel tank 20 is mounted, and include respective counterweight mounts 40A and 40B on which the counterweight 30 is mounted.

As depicted in FIG. 4, in a plan view of the engine frame 34, the fuel tank mount 39A is provided on the right (Y2) side of a position at which the counterweight mount 40A is formed at the rear end 38A, and the fuel tank mount 39B is provided on the left (Y1) side of a position at which the counterweight mount 40B is formed at the rear end 38B.

Thus, in the rear ends 38A and 38B, the fuel tank mounts 39A and 39B are at a distance from the counterweight mounts 40A and 40B, respectively, in the right-left direction (the width direction of the shovel), and the fuel tank mounts 39A and 39B overlap the counterweight mounts 40A and 40B, respectively, when viewed in the right-left direction (the width direction of the shovel).

Figure 6:
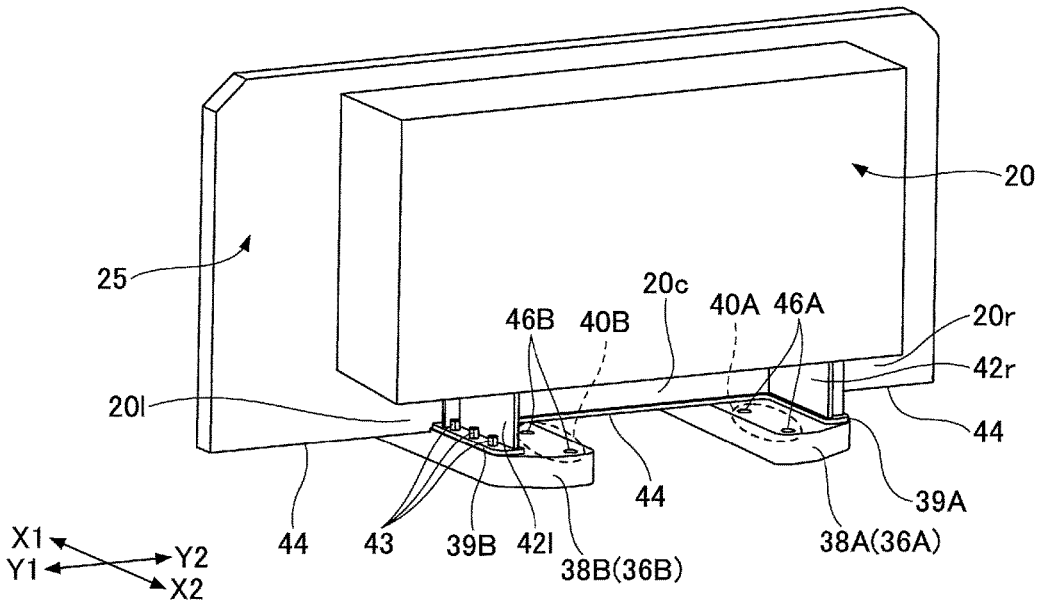
FIG. 6 is a perspective view of the fuel tank for illustrating the attachment of the fuel tank to fuel tank mounts according to the embodiment.

Next, the mounting structure of the fuel tank 20 and the counterweight 30 on the engine frame 34 is described basically with reference to FIGS. 4 and 6.

In FIG. 4, the bottom shape of the fuel tank 20 and the counterweight 30 mounted on the engine frame 34 is indicated by a two-dot chain line. FIG. 6 is a rear-side perspective view of the fuel tank 20 mounted on the fuel tank mounts 39A and 39B of the rear ends 38A and 38B.

The fuel tank 20 includes a tank fixing right-side bracket 42*r* and a tank fixing left-side bracket 42*l* provided at the bottom of the fuel tank 20. The tank fixing right-side bracket 42*r* and the tank fixing left-side bracket 42*l* are fixed to the fuel tank mounts 39A and 39B, respectively, using bolts 43 serving as fasteners.

Thus, the fuel tank 20 is fixed to the rear ends 38A and 38B through the tank fixing right-side bracket 42*r* and the tank fixing left-side bracket 42*l*. The bolts 43 are inserted into insertion holes 45A and 45B formed in the rear ends 38A and 38B (the beams 36A and 36B), respectively, from below the rear ends 38A and 38B to fix the tank fixing right-side bracket 42*r* and the tank fixing left-side bracket 42*l* to the fuel tank mounts 39A and 39B.

As a result of providing the tank fixing right-side bracket 42*r* and the tank fixing left-side bracket 42*l* at the bottom of the fuel tank 20, a space is formed under the fuel tank 20 as depicted in FIG. 6. This space is divided into three spaces, namely, a right-side space 20*r*, a center space 20*c*, and a left-side space 20*l*, by the tank fixing right-side bracket 42*r* and the rear end 38A and by the tank fixing left-side bracket 42*l* and the rear end 38B.

Referring to FIG. 6, a space 44 is formed under the partition plate 25 disposed between the engine 11 and the fuel tank 20. This allows the rear ends 38A and 38B of the engine frame 34 to extend into the hollow 31 of the counterweight 30 through the space 44.

As described above, the right-side cut 33*r* and the left-side cut 33*l* are formed at the bottom of the counterweight 30. The right-side cut 33*r* and the left-side cut 33*l* are distant from each other in the right-left direction.

The right-side cut 33*r* is formed at a position corresponding to a position at which the tank fixing right-side bracket 42*r* is formed. The left-side cut 33*l* is formed at a position corresponding to a position at which the tank fixing left-side bracket 42*l* is formed.

The right bottom wall 30*br* is formed at a position corresponding to the position of the right-side space 20*r*. The center bottom wall 30*bc* is formed at a position corresponding to the position of the center space 20*c*. The left bottom wall 30*b*1 is formed at a position corresponding to the position of the left-side space 20*l*.

In mounting the counterweight 30 on the engine frame 34, the counterweight 30 is inserted forward (in the direction of the arrow X1) into the engine frame 34 on which the fuel tank 20 is mounted.

As depicted in FIG. 4, when the counterweight 30 is mounted on the engine frame 34, the tank fixing right-side bracket 42*r* is inserted in the right-side cut 33*r*, the tank fixing left-side bracket 42*l* is inserted in the left-side cut 33*l*, the right bottom wall 30*br* is inserted in the right-side space 20*r*, the center bottom wall 30*bc* is inserted in the center space 20*c*, and the left bottom wall 30*bl*is inserted in the left-side space 20*l*.

When the counterweight 30 is mounted on the engine frame 34, a left-side (Y1-side) predetermined portion of the center bottom wall 30*bc* is mounted on the counterweight mount 40B of the rear end 38B, and a right-side (Y2-side) predetermined portion of the center bottom wall 30*bc* is mounted on the counterweight mount 40A of the rear end 38A.

In the center bottom wall 30*bc*, bolt holes (not depicted) are formed at positions corresponding to through holes 46A and 46B formed in the counterweight mounts 40A and 40B. To fix the counterweight 30 to the counterweight mounts 40A and 40B, bolts serving as fasteners are inserted into the through holes 46A and 46B formed in the counterweight mounts 40A and 40B, respectively, from below the rear ends 38A and 38B to be fixed to the bolt holes formed in the center bottom wall 30*bc*. The counterweight 30 is thus fixed to the counterweight mounts 40A and 40B.

Thus, according to this embodiment, the bolts that fix the counterweight 30 to the counterweight mounts 40A and 40B are inserted from below the rear ends 38A and 38B (the beams 36A and 36B) to be fixed to the counterweight 30. As described above, the bolts 43 that fix the fuel tank 20 to the fuel tank mounts 39A and 39B are inserted from below the rear ends 38A and 38B (the beams 36A and 36B) to be fixed to the fuel tank 20.

That is, according to this embodiment, it is possible to attach and detach fixing bolts from outside the fuel tank 20 and the counterweight 30. This facilitates the attachment and detachment of the fuel tank 20 and the counterweight 30.

Furthermore, according to this embodiment, when the counterweight 30 is detached from the counterweight mounts 40A and 40B for, for example, the maintenance of the fuel tank 20, the fuel tank 20 is kept fixed to the fuel tank mounts 39A and 39B.

Thus, by mounting the fuel tank 20 and the counterweight 30 separate from each other on the rear ends 38A and 38B (the beams 36A and 36B), it is possible to attach and detach the counterweight 30 independent of the fuel tank 20.

Therefore, assemblability is improved at the time of assembly. Furthermore, the detachability of the counterweight 30 is improved in the case of detaching the counterweight 30 for, for example, maintenance.

According to this embodiment, as depicted in FIG. 4, the through holes 46A and 46B formed in the counterweight mounts 40A and 40B are disposed within a width t of the beams 36A and 36B in the rear ends 38A and 38B, and are positioned on longitudinal centerlines 48A and 48B (each indicated by a one-dot chain line in FIG. 4) of the beams 36A and 36B, respectively. The through holes 46A and 46B, however, do not have to be on the centerlines 48A and 48B if disposed within the width t of the beams 36A and 36B. The boom 4 is pivotably attached to the beams 36A and 36B through the boom foot pins 4*a* with a longitudinal centerline 4*a* of the boom 4 extending parallel to the centerlines 48A and 48B of the beams 36A and 36B.

Therefore, a load and a moment that are generated when the counterweight 30, which is heavier than the fuel tank 20, is mounted on the counterweight mounts 40A and 40B can be received at part of high stiffness in the engine frame 34, namely, the beams 36A and 36B. Likewise, a load and a moment generated by the excavation attachment can be received at part of high stiffness in the engine frame 34, namely, the beams 36A and 36B. Therefore, it is possible to securely support the counterweight 30 and the excavation attachment, which are heavy items, by the engine frame 34.

The fuel tank mounts 39A and 39B are disposed on the outer side of the counterweight mounts 40A and 40B, respectively. This, however, causes no problem because the fuel tank 20 is lighter than the counterweight 30.

The above-described embodiment may be applied to a wide variety of work machines used for, for example, forestry works, demolition works, and earthworks.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A work machine comprising:

a lower-part traveling body;

an upper-part turning body turnably disposed on the lower-part traveling body;

an arm;

a boom having a first end connected to the upper-part turning body and a second end connected to the arm;

a cab mounted on a front left of a frame of the upper-part turning body;

an engine disposed behind the cab on the frame;

a fuel tank disposed behind the engine on the frame;

a counterweight disposed behind the fuel tank on the frame; and a partition mounted on the frame between a first space in which the engine is disposed and a second space in which the fuel tank is disposed, wherein the fuel tank is disposed in a hollow formed in the counterweight.

2. The work machine as claimed in claim 1, further comprising:

a fuel hose extending from the fuel tank to pierce through the partition.

3. The work machine as claimed in claim 2, wherein the fuel hose is routed to a hydraulic pump chamber through the partition to connect to a fuel pump disposed in the hydraulic pump chamber.

4. The work machine as claimed in claim 1, wherein the partition shields a space inside the hollow in which the fuel tank is disposed from heat generated from the engine.

5. The work machine as claimed in claim 4, wherein the counterweight includes an upper wall, a first sidewall, a second sidewall, and a bottom wall that form a frame body, and a rear wall that closes one of openings of the frame body.

6. The work machine as claimed in claim 5, further comprising:

a shield wall provided in front of the engine, wherein the shield wall and the partition form the first space in a front-to-rear direction of the upper-part turning body, and the partition and the rear wall form the second space in the front-to-rear direction of the upper-part turning body.

7. The work machine as claimed in claim 1, wherein a cut is formed at a bottom of the counterweight.

8. A work machine comprising:

a lower-part traveling body;

an upper-part turning body turnably disposed on the lower-part traveling body;

an arm;

a boom having a first end connected to the upper-part turning body and a second end connected to the arm;

a cab mounted on a front left of a frame of the upper-part turning body;

an engine disposed behind the cab on the frame;

a counterweight mount provided on the frame; and a fuel tank mount provided on the frame separately from the counterweight mount, the fuel tank mount being spaced apart from the counterweight mount in a width direction of the frame;

a fuel tank mounted on the fuel tank mount and disposed behind the engine; and a counterweight mounted on the counterweight mount and disposed behind the fuel tank, wherein the fuel tank is disposed in a hollow formed in the counterweight, and wherein there is an overlap between the fuel tank mount and the counterweight mount in the width direction of the frame when the fuel tank mount and the counterweight mount are viewed in the width direction of the frame.

9. The work machine as claimed in claim 8, wherein the counterweight mount is provided on a beam of the frame.

10. The work machine as claimed in claim 9, wherein an insertion hole formed in the counterweight mount is disposed within a width of the beam, and a longitudinal centerline of the beam and a longitudinal centerline of the boom are parallel to each other.

11. The work machine as claimed in claim 9, wherein the fuel tank mount is provided on the beam of the frame on an outer side of the counterweight mount in the width direction of the frame.

12. The work machine as claimed in claim 8, further comprising:

a plurality of beams that form a part of the frame, the plurality of beams being elongated in a longitudinal direction of the frame perpendicular to the width direction thereof with a predetermined interval between the plurality of beams in the width direction of the frame, wherein the fuel tank and the counterweight are disposed at a rear longitudinal end of the plurality of beams, and wherein there is the overlap between the fuel tank mount and the counterweight mount on a beam of the plurality of beams.

13. The work machine as claimed in claim 8, wherein the counterweight mount and the fuel tank mount are arranged side by side in the width direction of the frame, and a part of the counterweight mount and a part of the fuel tank mount are aligned in the width direction of the frame.

14. A work machine comprising:

a lower-part traveling body;

an upper-part turning body turnably disposed on the lower-part traveling body;

an arm;

a boom having a first end connected to the upper-part turning body and a second end connected to the arm;

a cab mounted on a front left of a frame of the upper-part turning body;

an engine disposed behind the cab on the frame;

a fuel tank disposed behind the engine on the frame; and a counterweight disposed behind the engine on the frame and covering the fuel tank from above the fuel tank.

* * * * *